United States Patent [19]

Ritter et al.

[11] Patent Number: 4,881,870

[45] Date of Patent: Nov. 21, 1989

[54] AIR BLOWER SAFETY CONTROL

[75] Inventors: Gregory A. Ritter, Leucadia; Graham Barton, Carlsbad; Ronald J. Sargent, Escondido, all of Calif.

[73] Assignee: Alopex Industries, Inc., San Marcos, Calif.

[21] Appl. No.: 271,611

[22] Filed: Nov. 15, 1988

[51] Int. Cl.[4] ..... F04D 29/58

[52] U.S. Cl. ..... 415/47; 412/12

[58] Field of Search ..... 236/101 D, 101 C, 93 R, 236/12.20, 49 B; 417/292, 280, 369, 366; 415/47, 12

[56] References Cited

U.S. PATENT DOCUMENTS

| | | | |
|---|---|---|---|
| 2,145,230 | 1/1939 | Arrighi | 236/101 C |
| 2,955,745 | 10/1960 | Hunter | 415/47 |
| 3,357,635 | 12/1967 | Ullery | 415/47 X |
| 4,057,372 | 11/1977 | Johnson et al. | 417/423.14 |
| 4,160,629 | 7/1979 | Hidden et al. | 417/366 |
| 4,248,570 | 2/1981 | Conger, IV | 417/423.14 |

*Primary Examiner*—Everette A. Powell, Jr.
*Attorney, Agent, or Firm*—Baker & McKenzie

[57] ABSTRACT

An air blower assembly for a spa having a vent valve in the outlet passage from the blower, with a bi-metallic coil for opening the valve and venting the outlet when the temperature reaches a preselected danger level. The valve comprises two telescoped tubular members having elongated vent ports movable angularly into alignment, the inner member being rotatably supported on the assembly for adjustment of the set point and the outer member being rotatable about the inner member by the coil.

7 Claims, 1 Drawing Sheet

AIR BLOWER SAFETY CONTROL

BACKGROUND OF THE INVENTION

This invention relates to air blower assemblies for spa tubs and the like, and has particular reference to a safety control for preventing the overheating of the blower of such an assembly.

A popular feature of most spa tubs is the provision of an air blower assembly which delivers air to the tub through a pattern of small air holes that are formed in the underwater surfaces of the tub. The air issuing through these holes forms a pattern of bubbles, having an invigorating effect that enhances the user's enjoyment.

The air blower assembly typically has an electric motor that drives a blower at high speed, forcing air under pressure into the passages and forcing out the water that occupies the passages when the blower assembly is not in use. After an initial build-up of pressure sufficient to clear the water out of the air passages, the bubbling commences.

Such motors and blowers operate at high speed and generate a substantial amount of heat in normal operation. This heat normally is removed by the air flow through the blower assembly and past the motor, and does no harm. It sometimes happens, however, that a portion of the outlet passages becomes obstructed, for example, by people sitting in the spa, and this tends to reduce the cooling air flow past the motor. At the same time, the blockage produces an increase in the air pressure in the system, and the increased pressure also increases the temperature level in the system. As a result, there is a substantial danger of overheating in spa blower assemblies, with resultant danger of damage to the equipment, and in particular, of burning out of the motor.

The primary objective of the present invention is to protect the spa blower assembly from overheating while at the same time providing for a full flow of air to the spa.

SUMMARY OF THE INVENTION

The present invention resides in an improvement in an air blower for spas and the like with which the temperature of air delivered by the blower assembly is monitored continuously. and a vent valve is provided for opening an escape passage in the event that a dangerously high temperature level occurs, thus relieving the back pressure on the blower, increasing the cooling air flow past the blower, and counteracting the factors that contribute to the tendency to overheat the blower assembly. In the preferred embodiment of the invention shown herein, the vent valve is mounted in one sidewall of the outlet passage of the blower assembly, and comprises two relatively movable valve members having vent ports adapted to be moved into alignment, and means for moving the members in response to an increasing temperature in the passage to open the valve and vent the passage when the temperature reaches a predetermined opening level, approaching the danger level for the blower assembly.

The illustrative valve has two relatively rotatable, tubular members that are telescoped together and have vent ports in the form of elongated slots that can be rotated into alignment with each other, the interior of the inner member being a vent passage leading to the outside of the outlet passage. The temperature-responsive means for moving the members is a bi-metallic coil disposed around the tubular members in the outlet passage and having one end anchored on the blower assembly and the other end connected to the outer tubular member to turn it back and forth as the temperature of the coil increases and decreases, bringing the vent ports together at a selected temperature. The positions of the valve parts can be set for venting by the valve at different selected temperature levels, an operation preferably performed at the factory.

Other features and advantages of the invention will become apparent from the following detailed description, taken in conjunction with the accompanying drawings.

DETAILED DESCRIPTION OF THE PREFERRED EMBODIMENT

Figure 1:
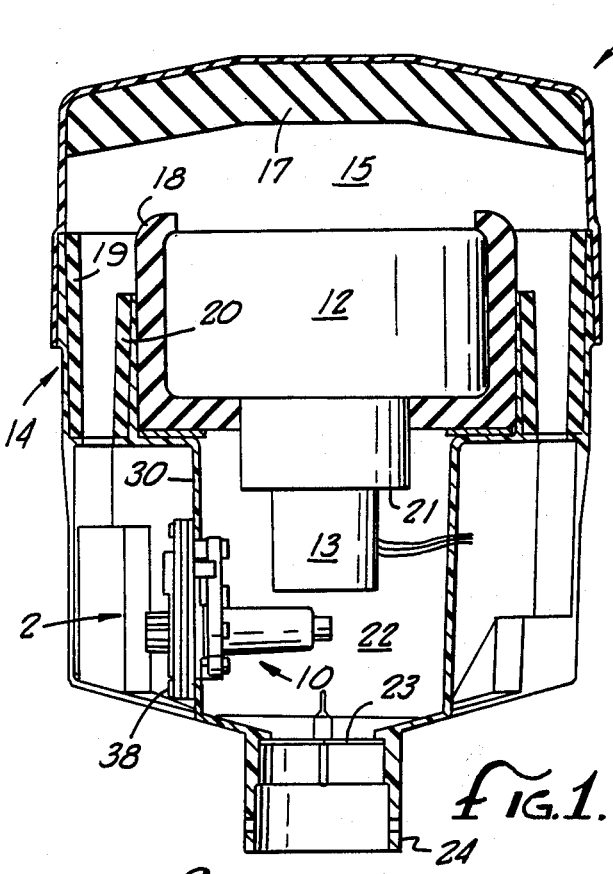
FIG. 1 is a vertical cross-sectional view taken through a representative spa blower assembly equipped with the safety control of the present invention.

As shown in the drawings for purposes of illustration, the invention is embodied in a safety control, indicated generally by the reference number 10 in the drawings, that is incorporated in an air blower assembly 11 (FIG. 1) that is representative of various types of air blower assemblies in which the safety control may be used. This blower assembly is designed for use with a spa tub (not shown), to deliver air under pressure to air holes in the tub to produce a bubbling action in the water in the tub, all in a manner that is generally well known in the art and therefore will not be described in detail herein.

The representative blower assembly 11 has a blower, indicated generally at 12, that is driven by an electric motor 13, these elements being enclosed in a case 14 below an air intake chamber 15 and surrounded by noise-insulating material at 17, 18, 19 and 20. Outside air flows into the motor from the chamber 15, and is exhausted under pressure through the lower end 21 of the blower to flow past the motor 13. The air flows out of the case 14 through an outlet passage 22, a one-way valve 23 permitting out-flow only, and an outlet fitting 24 that is connectable to a line (not shown) leading to the spa tub.

In accordance with the present invention, the safety control 10 is disposed in the outlet passage 22 in the path of air leaving the blower 12 and the motor 13, and includes a normally closed vent valve 25 defining an escape passage 27 from the outlet passage, and means for monitoring the temperature of the air and opening the vent valve when the temperature increases toward a dangerous level. In this manner, the pressure in the outlet passage is relieved and the cooling air flow through the blower and past the motor is increased, thereby counteracting two important factors that contribute to the overheating.

More specifically, in the preferred embodiment of invention shown herein, the vent valve 25 comprises two elongated tubular members 28 and 29 that are supported in the outlet passage 22 for relative rotary movement, projecting inwardly from the wall 30 of the passage and having two alignable ports 31 and 32 (FIG. 3) in their inner end portions. The inside member 28 has an annular enlargement or wheel 33 on its outer end portion, outside the wall 30, that is rotatably confined in a circular lip or track 34 that is formed on a mounting plate 35. The mounting plate is secured to a base plate 37, and the two plates are secured to the outside of the passage wall by screws 38. In this manner, the inner valve member 28 is rotatably mounted on the blower assembly 11.

The outer valve member 29 is rotatably mounted on the inner member 28, being telescoped over the inner member and held in place by a flexible "snap" detent 39 (FIG. 3) on the inner end of the inner member. Radial fingers 40 are formed on the outer end of the inner member, at a point spaced from the inside of the wall 30, and a coaxial hub 41 is secured to these fingers to mount the sensing means for the control.

Figure 3:
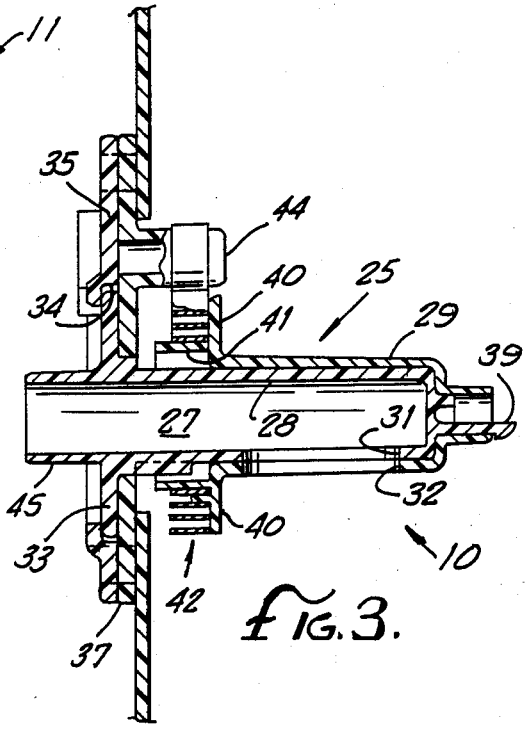
FIG. 3 is a cross-sectional view taken along the line 3—3 of FIG. 2, showing the valve in an open position.
Figure 4:
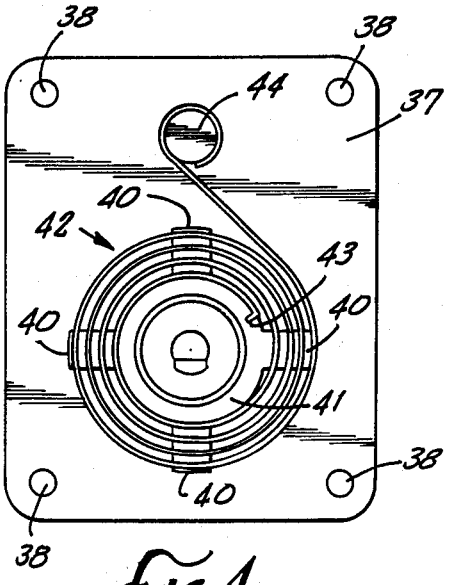
FIG. 4 is a view of the safety control taken from the inner side, opposite the side shown in FIG. 2.

As can be seen in FIGS. 3 and 4, the sensing means comprises an elongated bi-metallic coil 42 that is disposed around the hub 41 on the inner valve member 28 and secured at its radially inner end 43 (FIG. 4) to the hub. The coil is wrapped spirally around the hub, counterclockwise as viewed in FIG. 4, for several turns, the other end of the coil being anchored to a pin 44 that projects inwardly from the base plate 37. This coil operates in a conventional fashion, well known to those skilled in the art, to rotate the outer valve member 29 back and forth relative to the face plate 37, and the rest of the assembly, as the temperature to which the coil is exposed changes, much like a thermostat.

The vent ports 31 and 32 herein are elongated slots that are formed in the two valve members 28 and 29 to move into alignment as the members are rotated relative to each other, preferably being of the same length and width and occupying most of the length of the valve members inwardly from the coil 42. In a typical vent valve, these slots may be on the order of one to one and one-half inches long by three-sixteenths to one-quarter of an inch wide. These dimensions are only illustrative, however, and there is nothing critical about them.

Figure 2:
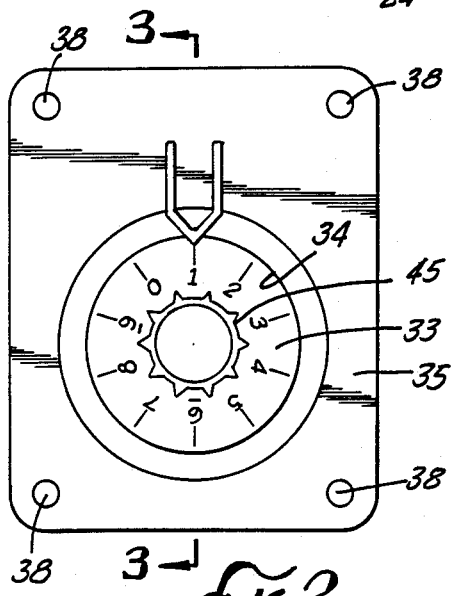
FIG. 2 is an enlarged fragmentary side elevational view of the safety control, taken from the outer side in the direction of the arrow 2 in FIG. 1.

Since the inner valve member 28 is rotatable in the outer mounting plate 35, the angular spacing of the inner port 31 from the outer port 32 at room temperature may be set by turning the accessible outer end 45 of the inner member, which herein has calibrations for indicating the position of the inner valve member, as shown in FIG. 2. This setting of the valve preferably is done as a factory operation, based upon empirical testing to determine the best set point for a given model of blower assembly. The lip on the face plate holds the wheel 33 on the inner member frictionally in a selected position, thus maintaining a selected setting.

The position of the outer member at room temperature is determined by the initial length and design of the bimetallic coil 42, which again can be determined by empirical testing. Data is available on the maximum operating temperature levels that are permissible with a given motor (typical blower assemblies use either a 1.5 H.P. or a 2.0 H.P. motor), and the bi-metallic coil can be selected and set up to provide the desired range of rotary valve movement as the motor temperature rises from room temperature through the range of operating temperatures that will be experienced.

With this arrangement, the safety control of the present invention monitors the actual temperature levels that occur in the air flow leaving the blower assembly, and thus directly sense the heating that is occurring in the motor 13. As the temperature level increases, the coil 42 turns the outer member 29 to move the outer port 32 toward the inner port 31, and the parts are set so that the ports overlap ad come into communication with each other, opening the vent valve, when the temperature level reaches the level selected for venting of the assembly.

It will be evident that the ports first will open a "crack", to release a small venting flow, but if the temperature continues to rise, the coil will progressively increase the extent of overlapping and the effective flow area through the ports until they are fully aligned. This gives maximum venting, and the flow area provided by the port when fully aligned can be designed to suit the needs of any blower assembly.

As the temperature level is reduced, the coil 42 will return the outer valve member toward its original position, eventually closing the vent valve to terminate the escape of air through the passage 27. The control remains effective, however, to protect the assembly whenever the operating temperature rises.

It will be seen that the present invention provides a simple but effective safety control that operates to reduce pressure in response to temperature rises, not pressure rises which are not effective indications that venting is needed. Indeed, high-pressure conditions occur each time a blower assembly is started and until the water in the air passages has been forced out by the air from the blower assembly. Thus, the invention uses temperature sensing in order to initiate corrective action in the form of pressure release.

It also will be evident that, while a particular embodiment of the invention has been illustrated and described, various modifications and changes may be made by those skilled in the art without departing from the spirit and scope of the invention.

We claim as our invention:

1. In an air blower assembly providing air under pressure to a spa, and including a blower having an air intake and an air outlet, and means defining an outlet passage for delivering air from said air outlet to a spa, the improvement comprising:

a vent valve mounted in said outlet passage and including a first valve member having a first vent port therein for communicating with the outlet passage, and a second valve member having a second vent port therein, said first and second valve members being relatively rotatable from a normal position in which said first member overlies and closes said first vent port to an open position in which said second vent port is aligned with said first vent port, and second said valve member having a passage communicating between said second port and the outside of said outlet passage;

and a bi-metallic coil disposed around said vent valve and having one end connected to said first valve member and an opposite end anchored in said blower assembly, said coil being set to hold said valve member with said second port spaced from said first port while the temperature is below a preselected opening temperature, and to rotate said valve member and bring said second port into overlapping relation with said first port when the temperature increases to said opening temperature, thereby to provide a vent for the escape of air from said outlet passage to release the pressure in the outlet passage, and to increase the air flow through the blower and past the motor.

2. An air blower assembly as defined in claim 1 wherein said ports are shaped to increase the effective flow area from said outlet passage as the extent of overlapping increases, and said bi-metallic coil is set to continue to rotate said valve member and increase the overlapping as the temperature increases above said preselected opening temperature.

3. In an air blower assembly providing air under pressure to a spa, and including a blower having an air intake and an air outlet, and means defining an outlet passage for delivering air from said air outlet to a spa, the improvement comprising:

a vent valve having a port that opens out of said outlet passage, and a valve member that is movable relative to said port between open and closed positions; and means for sensing the temperature level in said outlet passage, holding said valve member in a closed position while the temperature is below a preselected level, and moving said valve member to the open position when the temperature exceeds said preselected level to vent the pressure in the outlet-passage and to increase the air flow through the blower and past the motor.

4. An air blower assembly as defined in claim 3 wherein said means progressively increases the opening of said vent valve as the temperature increases above said preselected level.

5. An air blower assembly as defined in claim 3 wherein said vent valve comprises inner and outer telescoping tubular members having radially inner and outer ports therein that are rotatable into and out of alignment, the radially outer port being the aforementioned port that opens out of the outlet passage, and the radially inner port opening into the interior of the inner member.

6. An air blower assembly as defined in claim 5 wherein said inner member is rotatably supported in said blower assembly to set the angular position of the inner port, and said outer member is connected to said sensing means to be rotated thereby.

7. An air blower assembly as defined in claim 6 wherein said sensing means is a bi-metallic coil wrapped around said members and having an inner end secured to said outer member and an outer end anchored to said assembly.

* * * * *